US006662693B2

(12) United States Patent
Hu

(10) Patent No.: US 6,662,693 B2
(45) **Date of Patent: *Dec. 16, 2003**

(54) WRENCH WITH A FIXED MAXIMUM OPERATIONAL TORQUE

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/034,759

(22) Filed: Dec. 27, 2001

(65) Prior Publication Data

US 2003/0010163 A1 Jan. 16, 2003

(30) Foreign Application Priority Data

Jul. 13, 2001 (TW) ..... 90212017 U

(51) Int. Cl.[7] ..... B25B 23/14

(52) U.S. Cl. ..... 81/467; 81/478; 81/480; 464/35; 464/37

(58) Field of Search ..... 81/467, 478, 480, 81/481; 464/35, 37, 41

(56) References Cited

U.S. PATENT DOCUMENTS 2,157,574 A * 5/1939 Siesel ..... 464/35
2,300,652 A * 11/1942 Cooney ..... 81/483
2,332,971 A * 10/1943 Johnson ..... 81/480
2,396,027 A * 3/1946 Spayd ..... 81/480
2,601,044 A * 6/1952 Mayer ..... 81/480
2,768,547 A * 10/1956 Noell ..... 81/480
2,826,107 A * 3/1958 Woods ..... 81/480
2,972,271 A * 2/1961 Gill ..... 81/480
3,593,542 A * 7/1971 Urayama ..... 464/37
3,651,718 A * 3/1972 Thomasian ..... 81/480
4,238,978 A * 12/1980 Leone ..... 81/480
5,152,200 A * 10/1992 Kaplan ..... 81/467
6,439,086 B1 * 8/2002 Bahr ..... 81/467

* cited by examiner

*Primary Examiner*—James G. Smith
(74) *Attorney, Agent, or Firm*—Alan D. Kamrath; Rider Bennett, LLP

(57) ABSTRACT

A wrench includes a rod, a slide control member, a casing for rotatably accommodating the slide control member, and a retaining device. The rod comprises a driving portion on an end thereof for engaging with a fastener. The slide control member is securely mounted to the rod to turn therewith. The retaining device is mounted in the casing and includes an end operably connected to the slide control member. When a rotational force applied to the casing is smaller than an engaging force between the slide control member and the end of the retaining device, the slide control member and the rod are turned to thereby turn the fastener. When a rotational force applied to the casing is greater than the engaging force between the slide control member and the end of the retaining device, the casing slides while the slide control member and the rod are not turned.

20 Claims, 13 Drawing Sheets

A-A

B-B

B–B

A-A

B-B

WRENCH WITH A FIXED MAXIMUM OPERATIONAL TORQUE

BACKGROUND OF THE INVENTION

1. Field of the Invention

The present invention relates to a wrench with a fixed maximum operational torque to prevent damage to the object secured by a fastener driven by the wrench.

2. Description of the Related Art

FIG. 12A of the drawings illustrates a conventional wrench 1 having a hexagonal driving portion with six planar faces 2 for engaging with six faces of a hexagonal groove in a top face of a fastener. However, slide tends to occur between the planar faces of the driving portion of the wrench 1 and the faces of the fastener. FIG. 12B illustrates a so-called TROX wrench 3 having plural arcuate faces 4 for engaging with corresponding arcuate faces in a top face of a fastener. Such a TROX wrench 3 is used to tighten important parts of a car and cutting tools. As illustrated in FIG. 13, a blade 7 is tightened to a cutting tool 5 by a bolt 6. However, the expensive blade 7 tends to be damaged when the bolt 6 is excessively tightened. But the blade 7 could fly away and thus cause injury if the bolt 6 is not tightened to the desired extent.

SUMMARY OF THE INVENTION

An object of the present invention is to provide a wrench with a fixed maximum operational torque such that when the torque applied by the user is greater than the maximum operational torque, the wrench slides and the fastener is not turned. Thus, damage to the object secured by the fastener is prevented.

Another object of the present invention is to provide a wrench with a fixed maximum operational torque that can be altered in response to the actual use.

A wrench in accordance with the present invention comprises a rod, a slide control member, a casing for rotatably accommodating the slide control member, and a retaining means. The rod comprises a driving portion on an end thereof for engaging with a fastener. The slide control member is securely mounted to the rod to turn therewith. The retaining means is mounted in the casing and includes an end operably connected to the slide control member. When a rotational force applied to the casing is smaller than an engaging force between the slide control member and the end of the retaining means, the slide control member and the rod are turned to thereby turn the fastener. When a rotational force applied to the casing is greater than the engaging force between the slide control member and the end of the retaining means, the casing slides while the slide control member and the rod are not turned.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
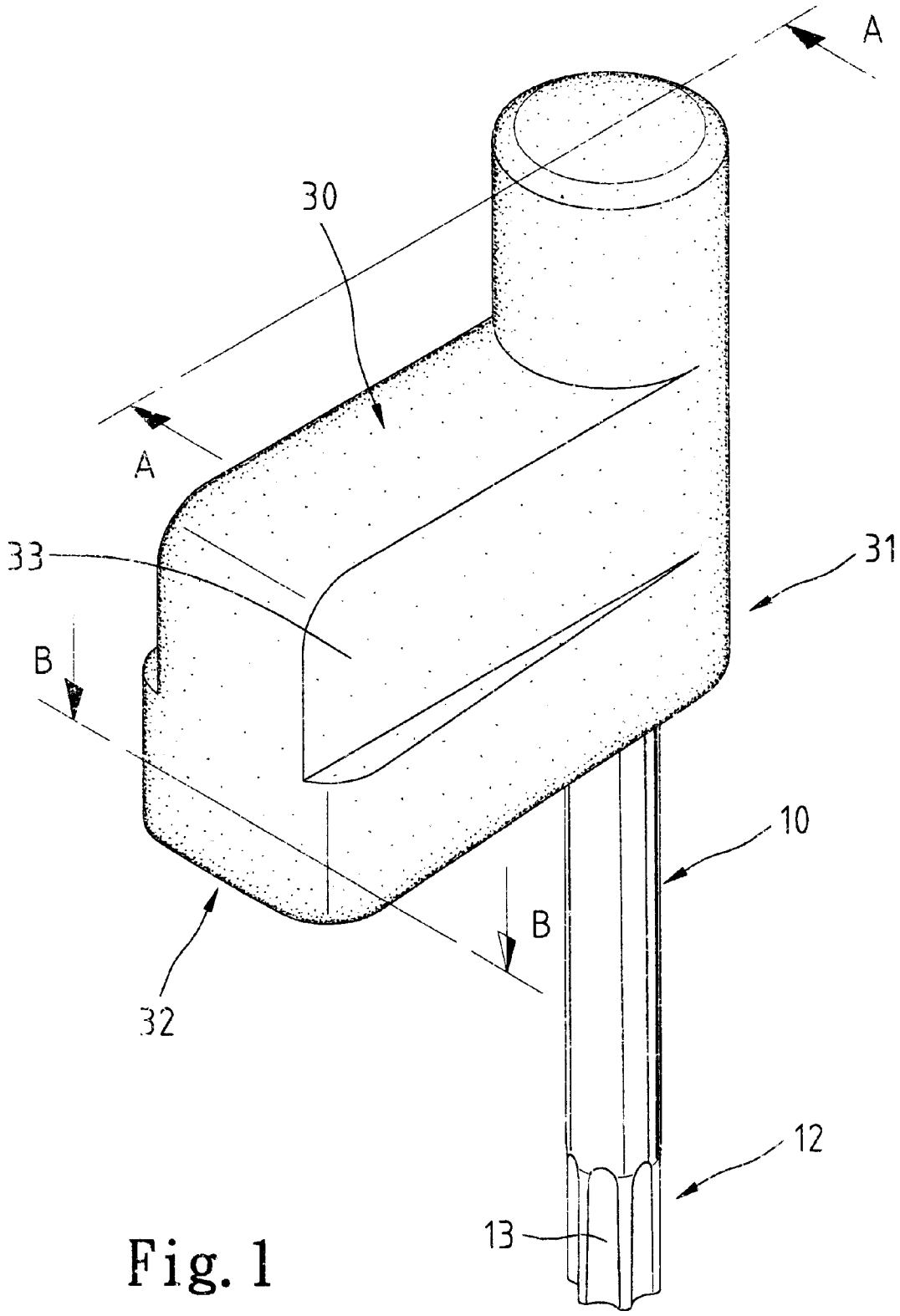
FIG. 1 is a perspective view of a wrench in accordance with the present invention.
Figure 2:
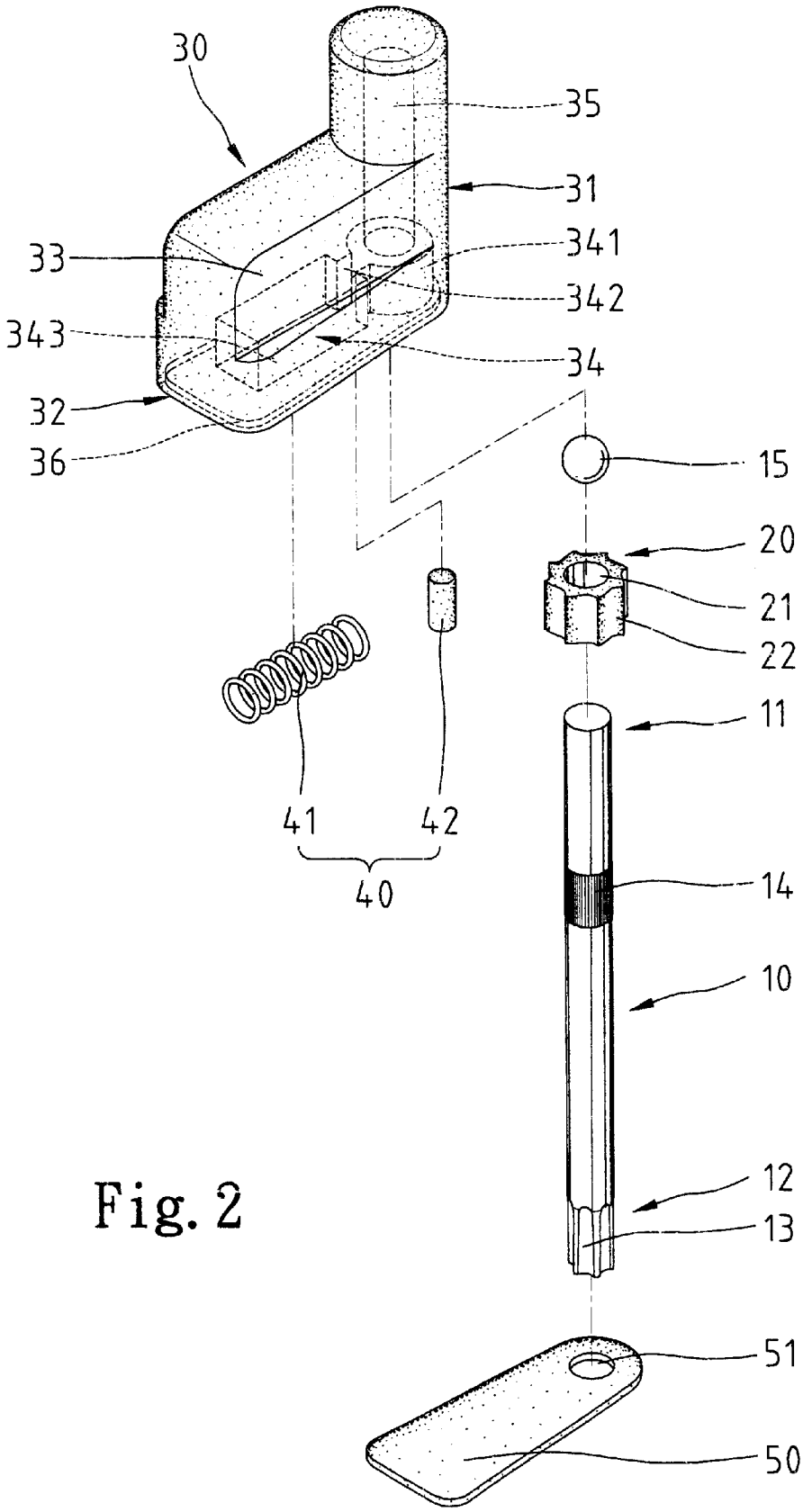
FIG. 2 is an exploded perspective view of the wrench in accordance with the present invention.

Referring to FIGS. 1 and 2, a wrench in accordance with the present invention generally includes a rod 10, a retaining means 40, a slide control member 20, and a casing 30. The rod 10 comprises a first end 11 and a second end 12 with a driving portion 13 for engaging with a fastener. In this embodiment, the driving portion 13 is shaped as a TROX type wrench. The rod 10 further has an embossed section 14 that is preferably adjacent to the first end 11 thereof.

The slide control member 20 includes a longitudinal hole 21 for securely engaging with the embossed section 14 of the rod 10. Thus, the slide control member 20 and the rod 10 rotate jointly. The slide control member 20 further includes an operative outer periphery 22. In this embodiment, the operative outer periphery 22 includes plural ratchet teeth; namely, the slide control member 20 is a ratchet wheel.

The casing 30 comprises a first end 31 and a second end 32. A grip portion 33 is formed on the second end 32 of the casing 30 for manual turning operation. A receiving section 34 is defined in the casing 30 for accommodating the retaining means 40 and the slide control member 20. The receiving section 34 includes a first compartment 341 for receiving the slide control member 20, a second compartment 342 for receiving a pressing member 42 of the retaining means 40, and a third compartment 343 for receiving an elastic element 41 of the retaining means 40. The three compartments 341, 342, and 343 are communicated with each other.

Figure 3:
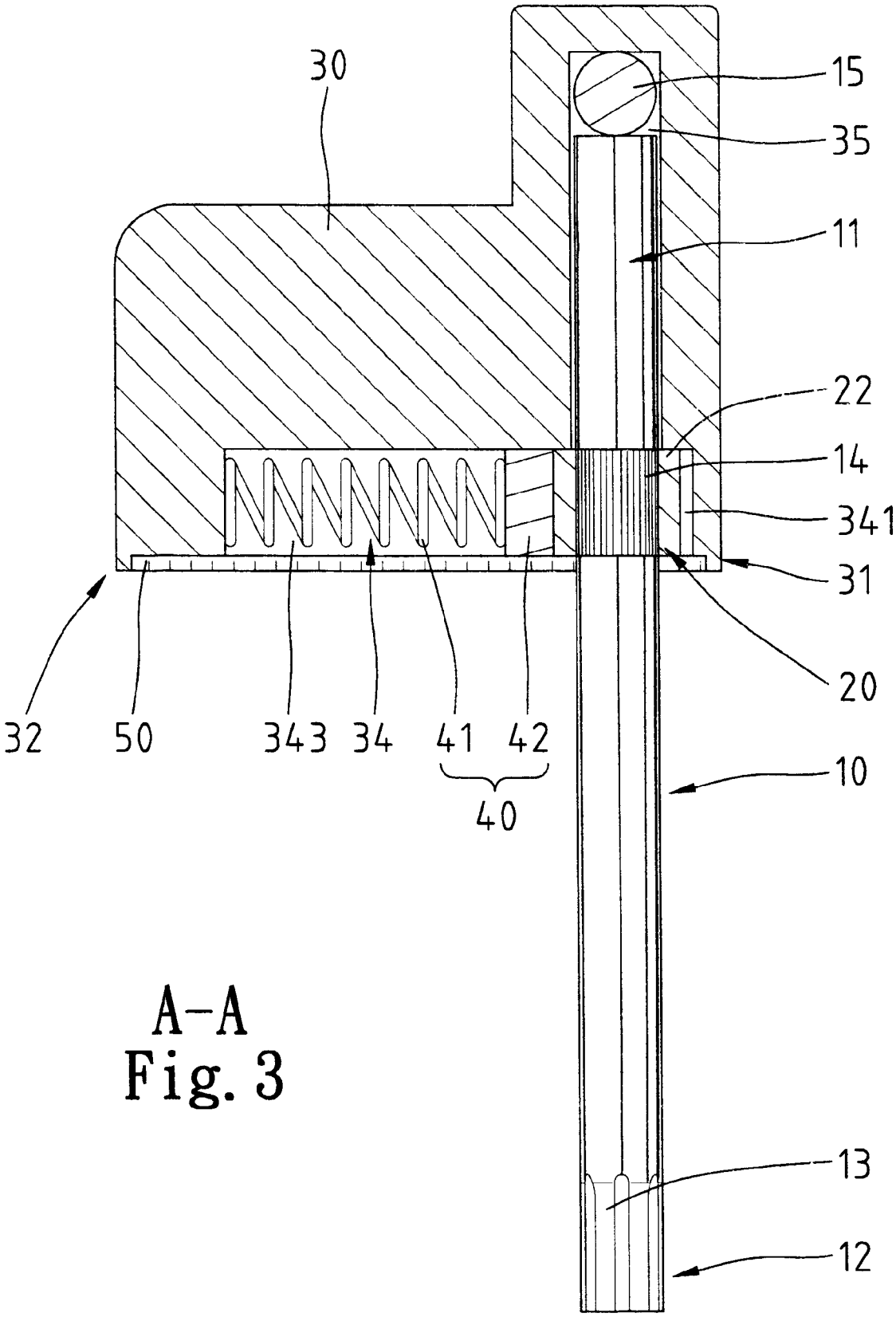
FIG. 3 is a sectional view taken along plane A—A in FIG. 1.

Referring to FIGS. 2 and 3, a positioning hole 35 is defined in the first end 31 of the casing 30 and extends through the first compartment 341. The first end 11 of the rod 10 is received in the positioning hole 35 of the casing 30, and a ball 15 is provided between an end face of the first end 11 of the rod 10 and an end wall defining a portion of the positioning hole 35 of the casing 30 to provide smooth rotation therebetween. A recessed portion 36 surrounds the receiving section 34 of the casing 30, and a lid 50 is mounted in the recessed portion 34 for closing the receiving section 34. The lid 50 has a hole 51 through which the rod 10 extends.

Figure 5:
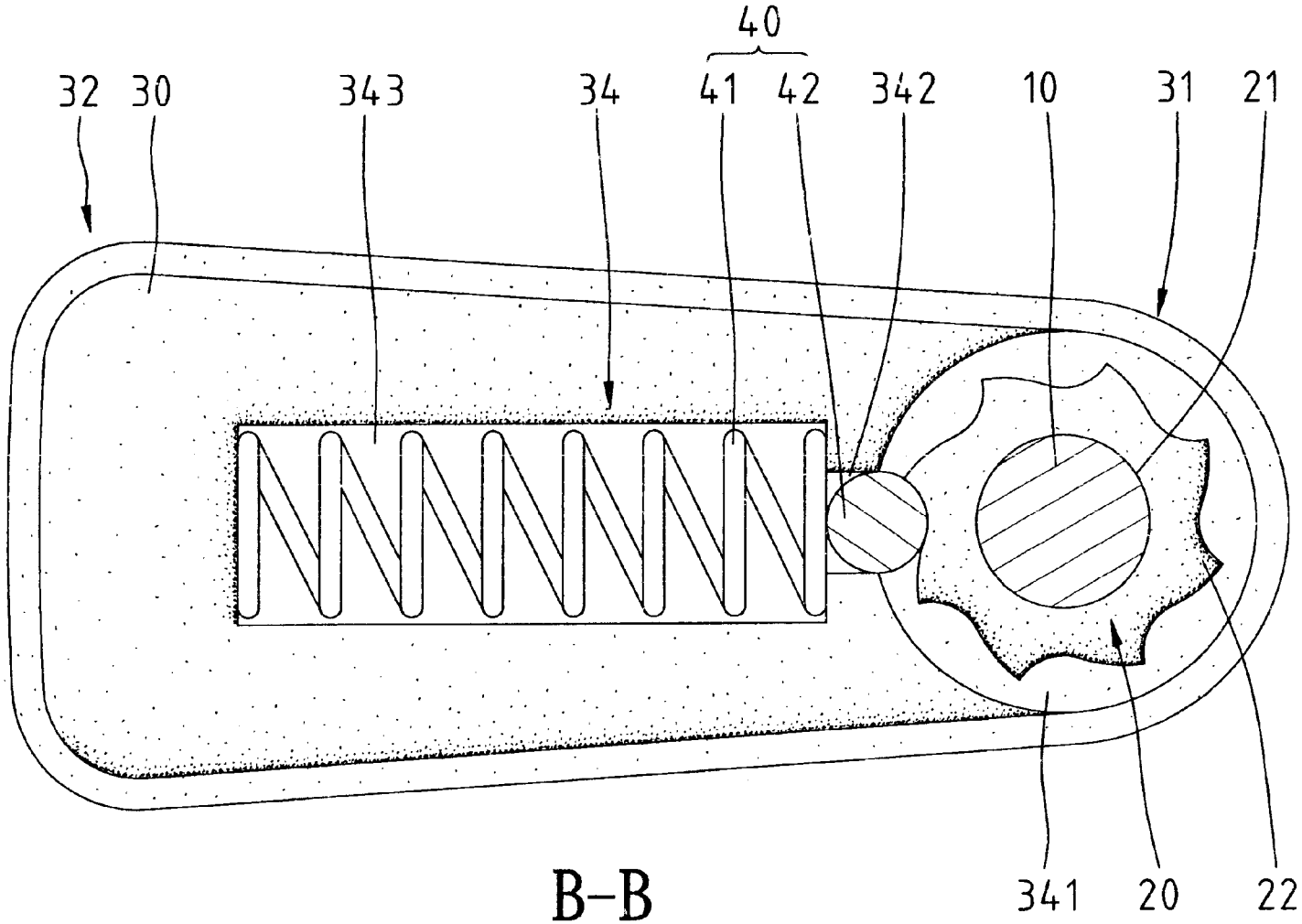
FIG. 5 is a sectional view taken along plane B—B in FIG. 1.

Referring to FIG. 5, the pressing member 42 is biased by the elastic element 41 to press against the operative outer periphery 22 of the slide control member 20. Namely, a predetermined engaging force exists between the operative outer periphery 22 of the slide control member 20 and the pressing member 42 under the action of the elastic element 41.

Figure 4:
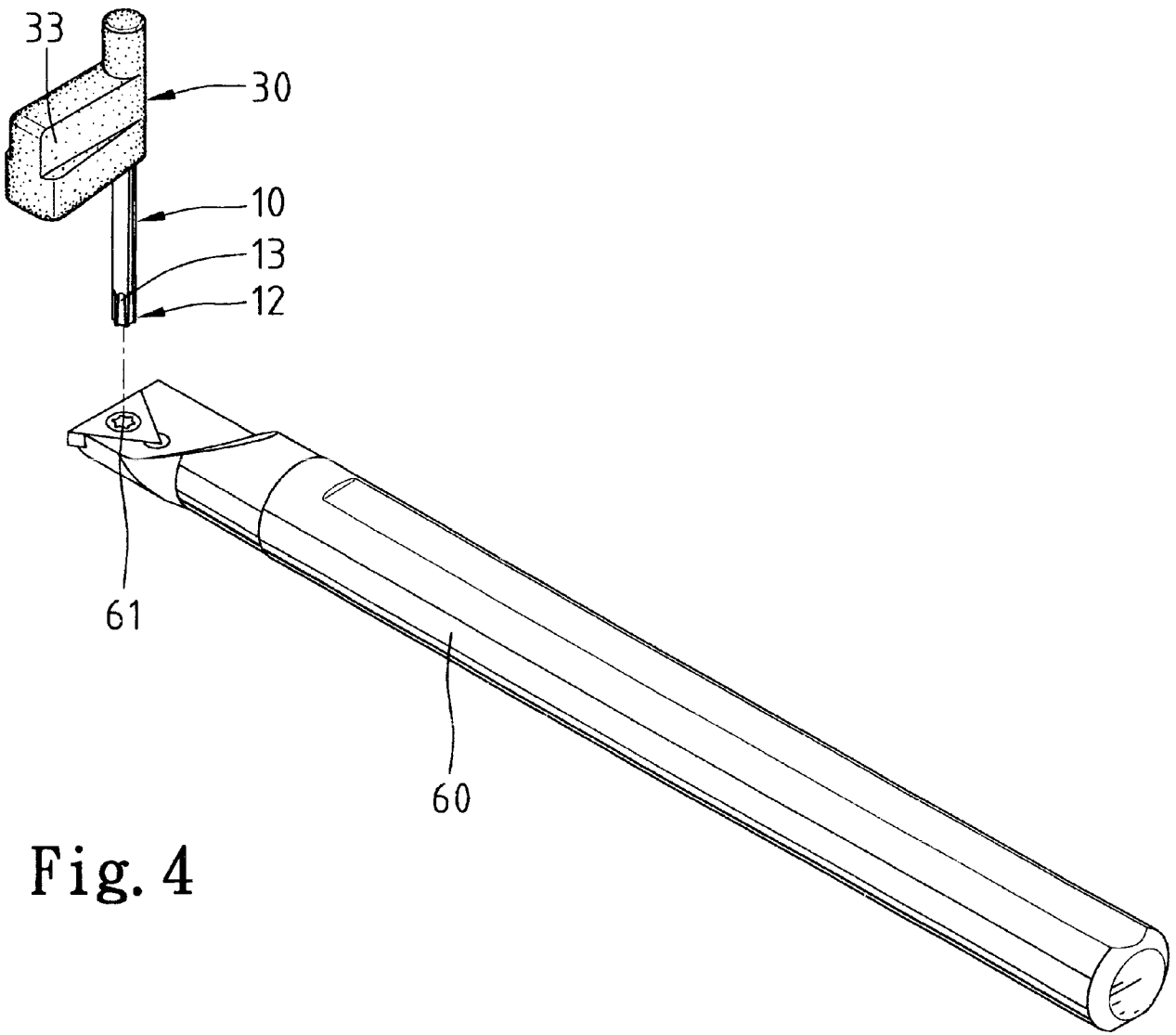
FIG. 4 is a perspective view illustrating use of the wrench in accordance with the present invention.

Referring to FIG. 4, when driving a TROX type bolt 61 for a cutting tool 60, the driving portion 13 of the second end 12 of the rod 10 is engaged with the bolt 61, and the casing 30 is then turned by means of gripping and turning the grip portion 33. Referring to FIG. 5, when the rotational force applied to the wrench is smaller than the predetermined engaging force between the pressing member 42 and the slide control member 20, the slide control member 20 and the rod 10 turn together with the casing 30 to thereby drive the bolt 61.

Figure 6:
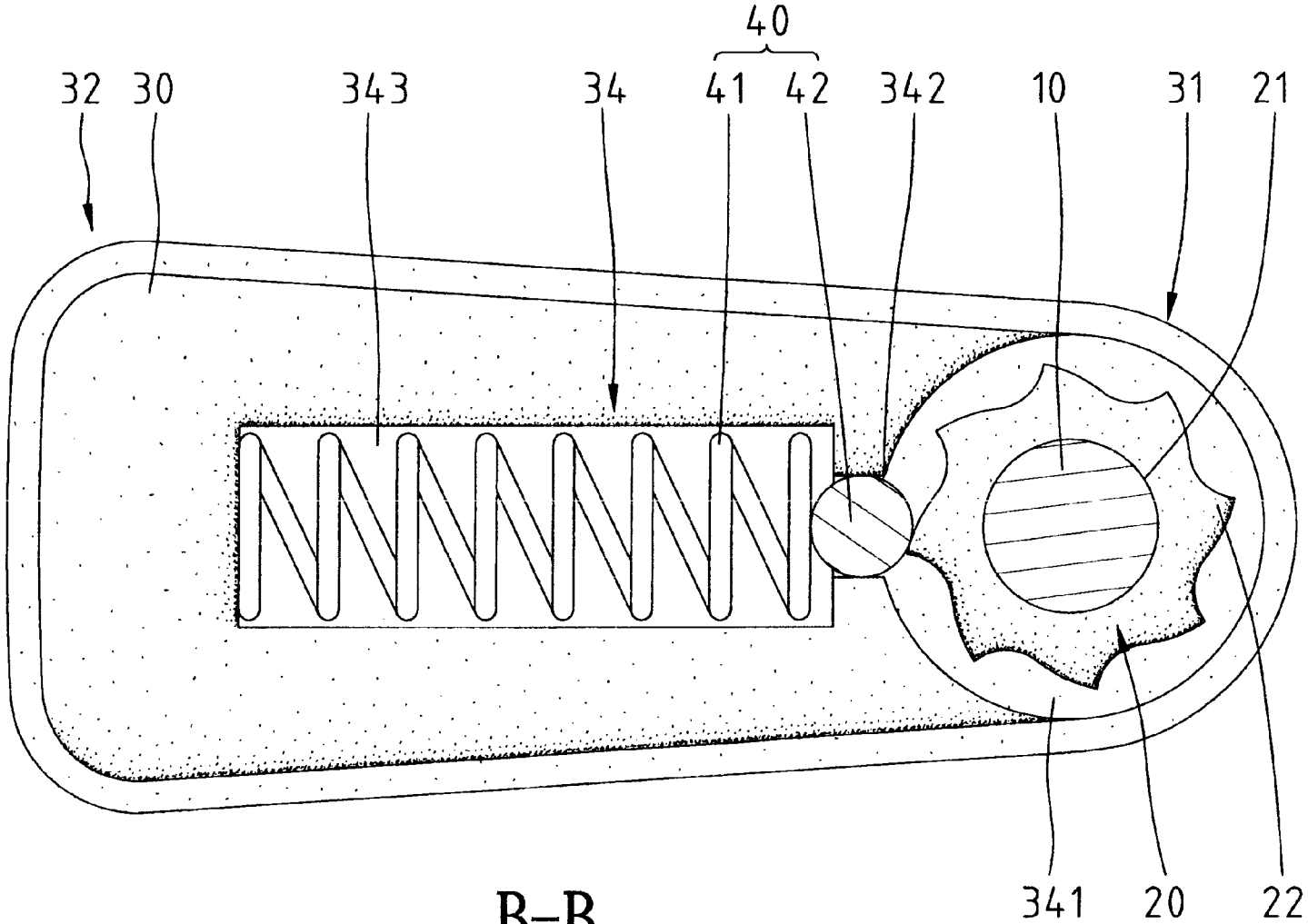
FIG. 6 is a sectional view similar to FIG. 5, illustrating operation of the wrench.

When the rotational force applied to the wrench is greater than the predetermined engaging force between the pressing member 42 and the slide control member 20, as illustrated in FIG. 6, the pressing member 42 is moved away from the slide control member 20 and compresses the elastic element 41, as the elastic force of the elastic element 41 is overcome by the rotational force. Thus, the casing 30 slides relative to the slide control member 20; namely, the slide control member 20 and the rod 10 are not turned. As a result, the bolt 61 is not turned. The casing 30 returns to its original position shown in FIG. 5 under the action of the elastic element 41 when the rotational force is released.

It is noted that the engaging force, which largely depends on the elastic coefficient of the elastic element 41, determines a maximum operational torque for turning the rod 10. Namely, when the torque applied to the casing 30 is smaller than the maximum operational torque, the slide control member 20 and the rod 10 are turned, and when the torque applied to the casing 30 is greater than the maximum operational torque, the slide control member 20 and the rod 10 are not turned. During tightening of the bolt 61, the bolt 61 before being tightened is turned by means of applying a torque smaller than the maximum operational torque. When the bolt 61 is tightened, the torque required to turn the casing 30 would be greater than the maximum operational torque such that the casing 30 slides. Thus, the user will notice the sliding motion of the casing 30 and be aware of tightening of the bolt 61. The maximum operational torque can be altered by means of selecting elastic elements of different elastic coefficients. The maximum operational torque is a constant and thus allows accurate operation. This advantageous design can be used in a limited space, and the manufacturing cost of the wrench is largely reduced.

Figure 7:
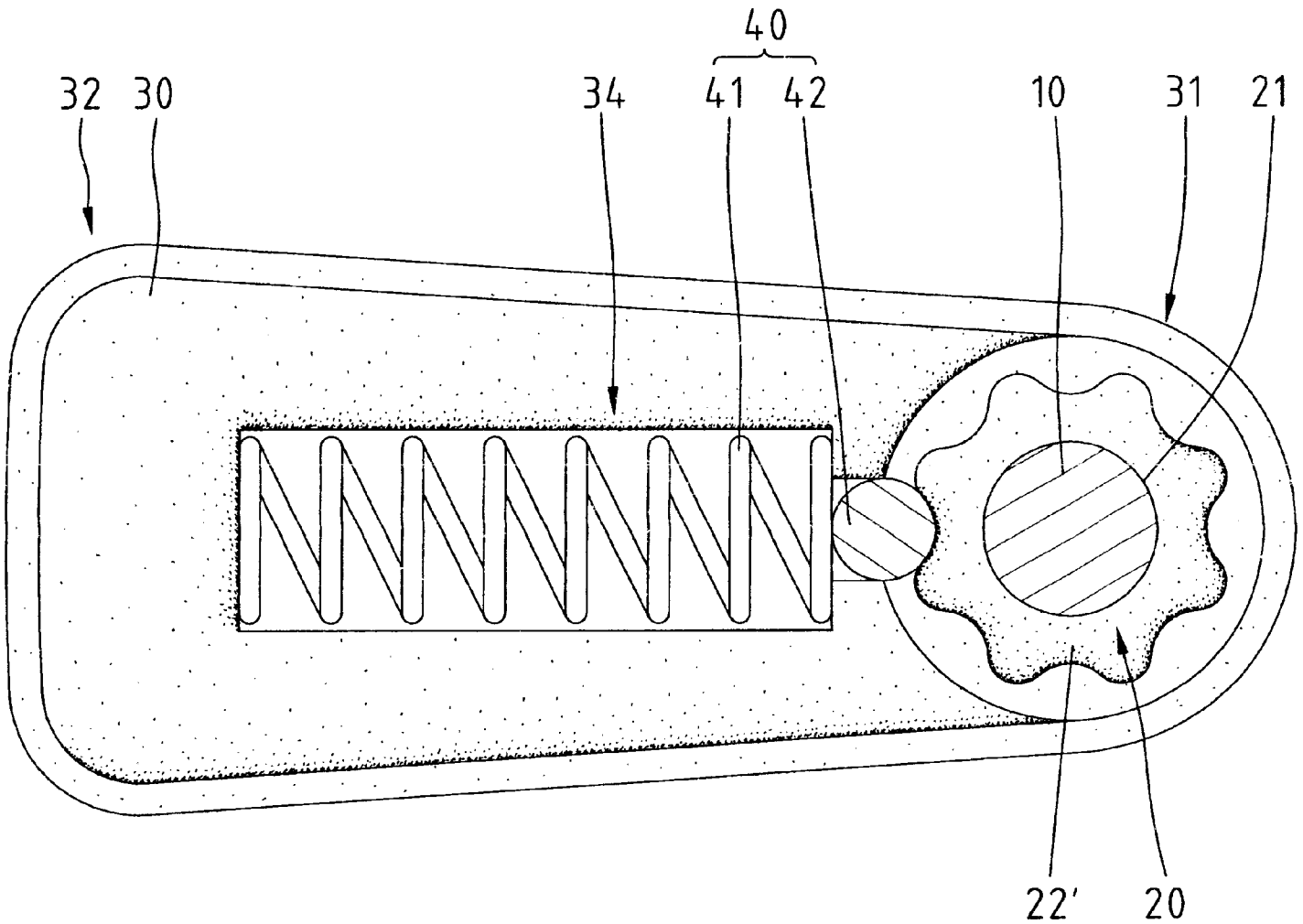
FIG. 7 is a sectional view similar to FIG. 5, illustrating a modified embodiment of the wrench in accordance with the present invention.
Figure 8:
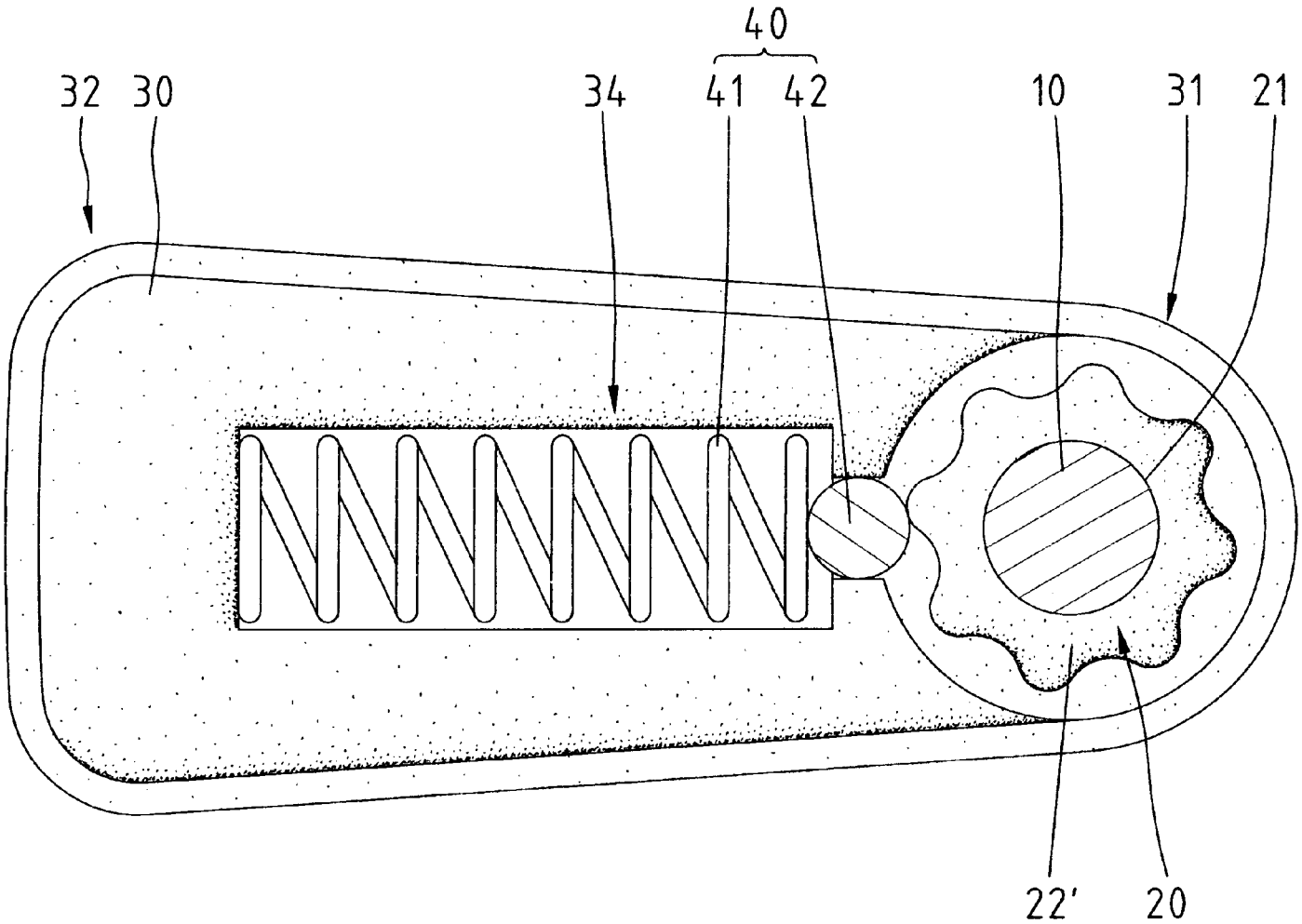
FIG. 8 is a sectional view similar to FIG. 7, illustrating operation of the wrench in FIG. 7.

FIGS. 7 and 8 illustrate a modified embodiment of the invention, wherein the slide control member 20 is a gear having an operative outer periphery 22'. This allows rotation of the casing 30 in either direction, while the casing 30 in the first embodiment can be turned in only one direction.

Figure 9:
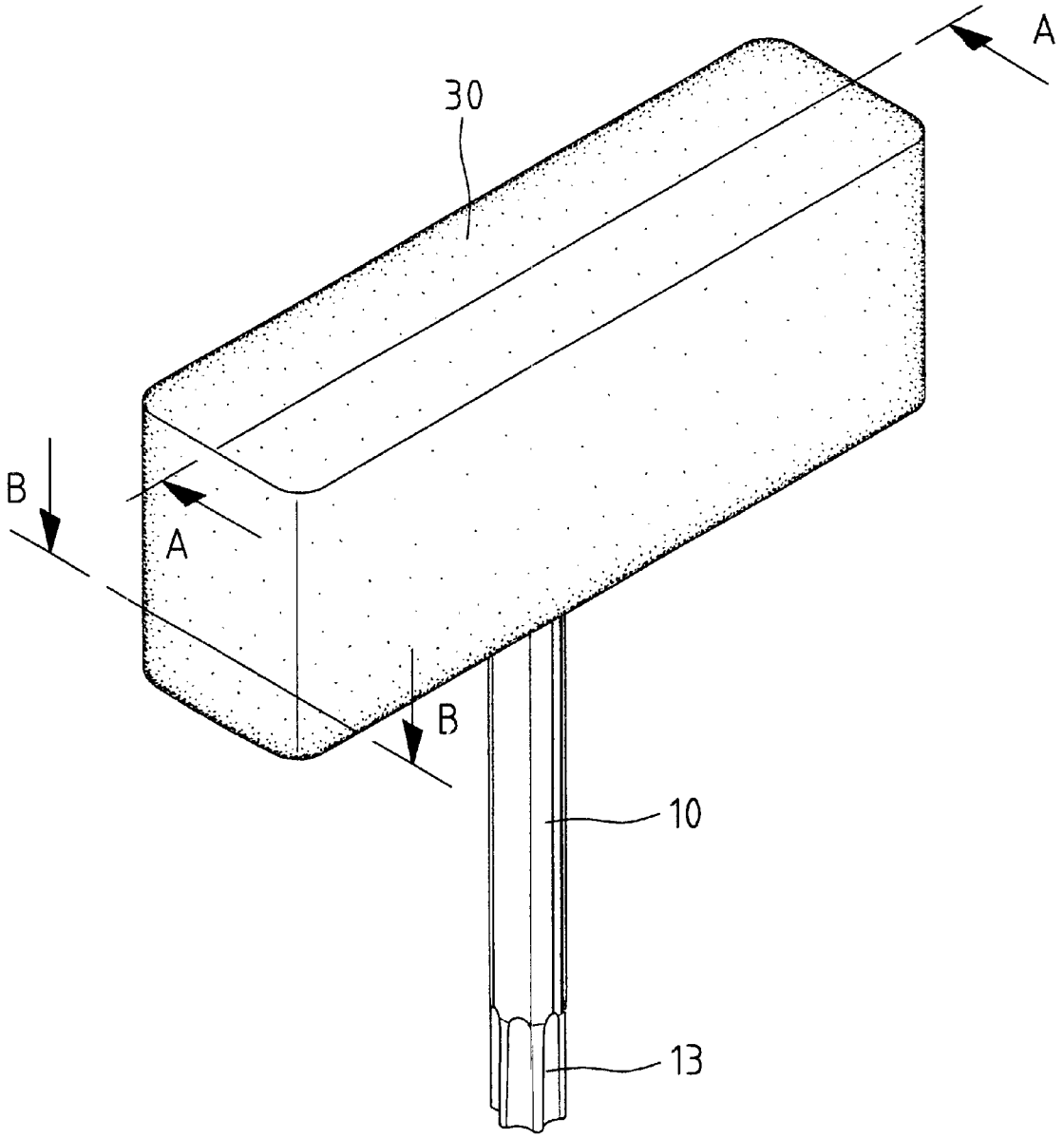
FIG. 9 is a perspective view of another modified embodiment of the wrench in accordance with the present invention.
Figure 10:
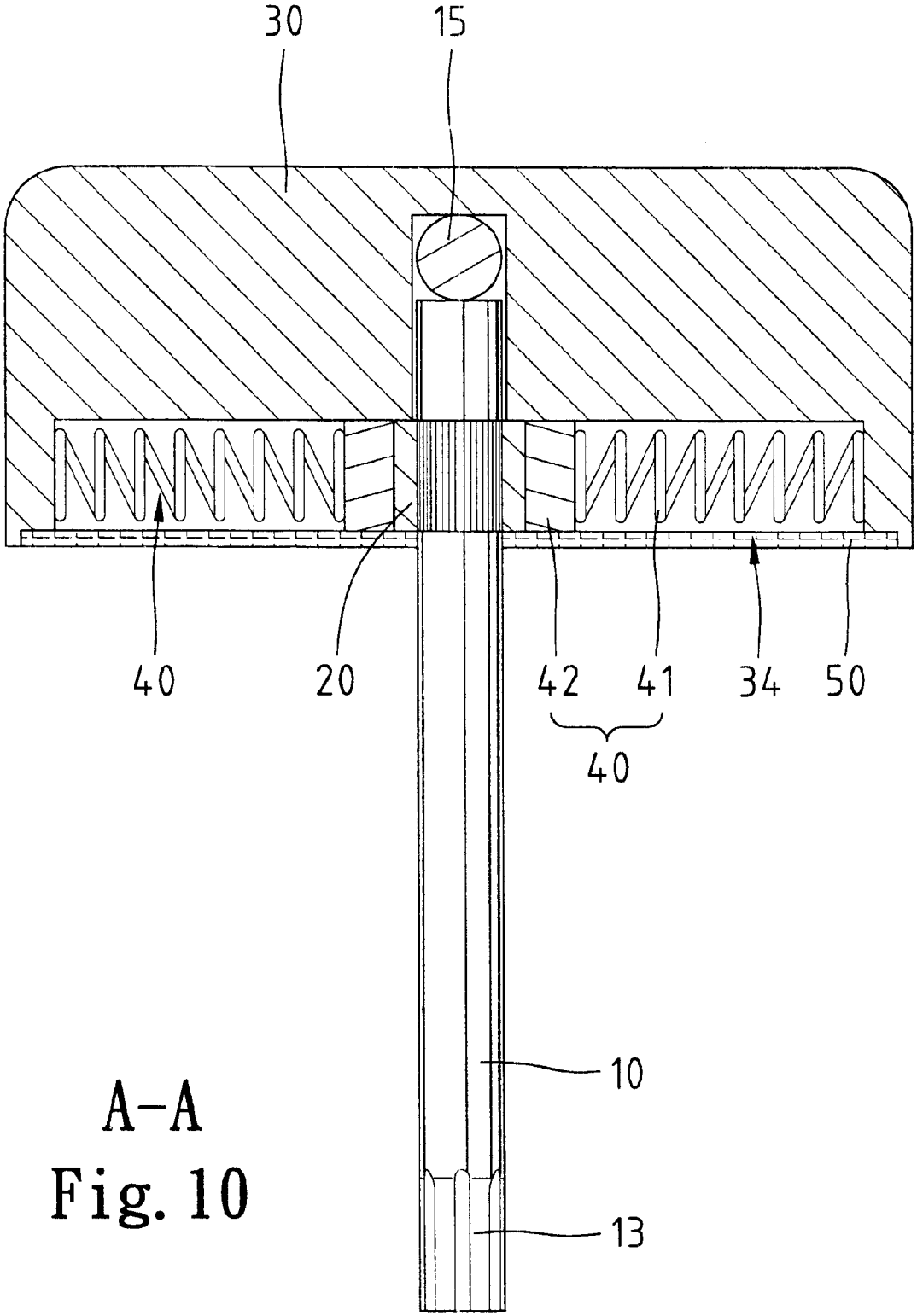
FIG. 10 is a sectional view taken along plane A—A in FIG. 9.
Figure 11:
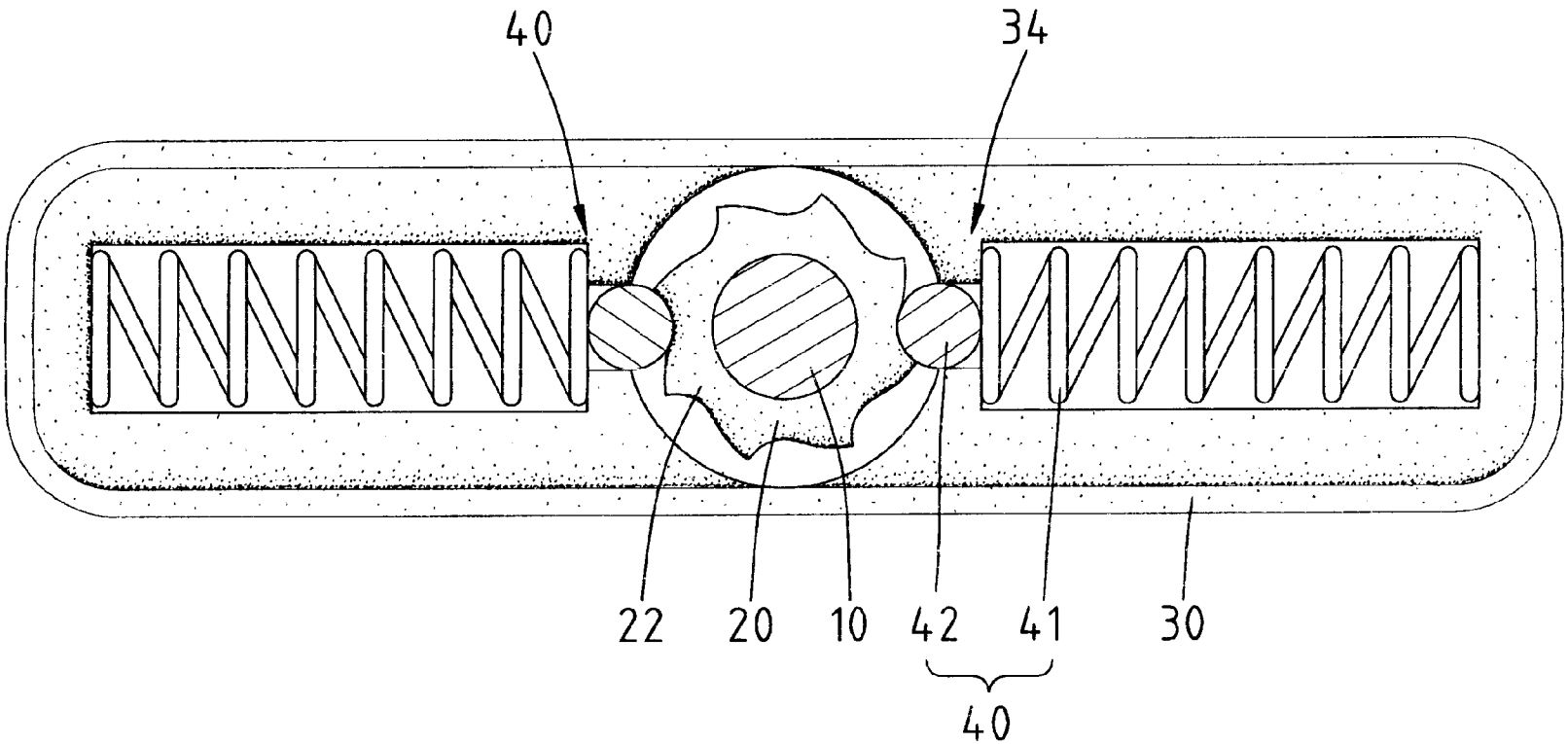
FIG. 11 is a sectional view taken along plane B—B in FIG. 9.
Figure 12A:
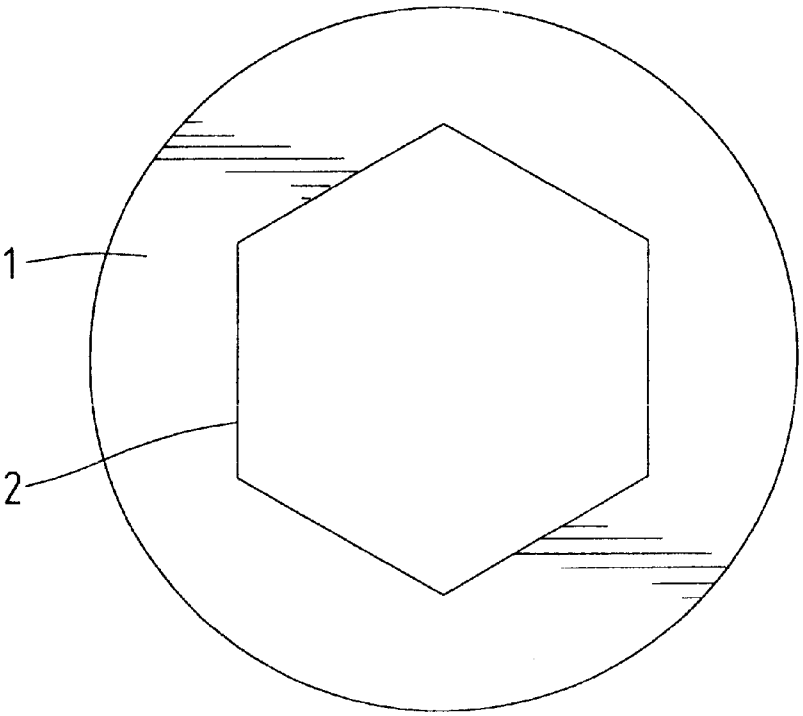
Fig. 12A PRIOR ART
FIG. 12A is an end view of a conventional hexagonal wrench.
Figure 12B:
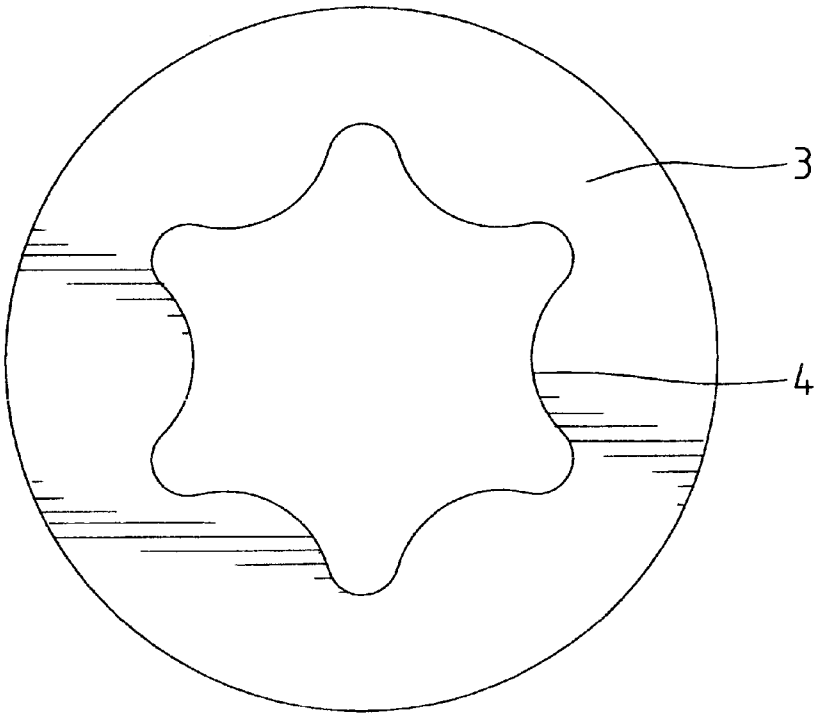
Fig. 12B PRIOR ART
FIG. 12B is an end view of a conventional TROX wrench.
Figure 13:
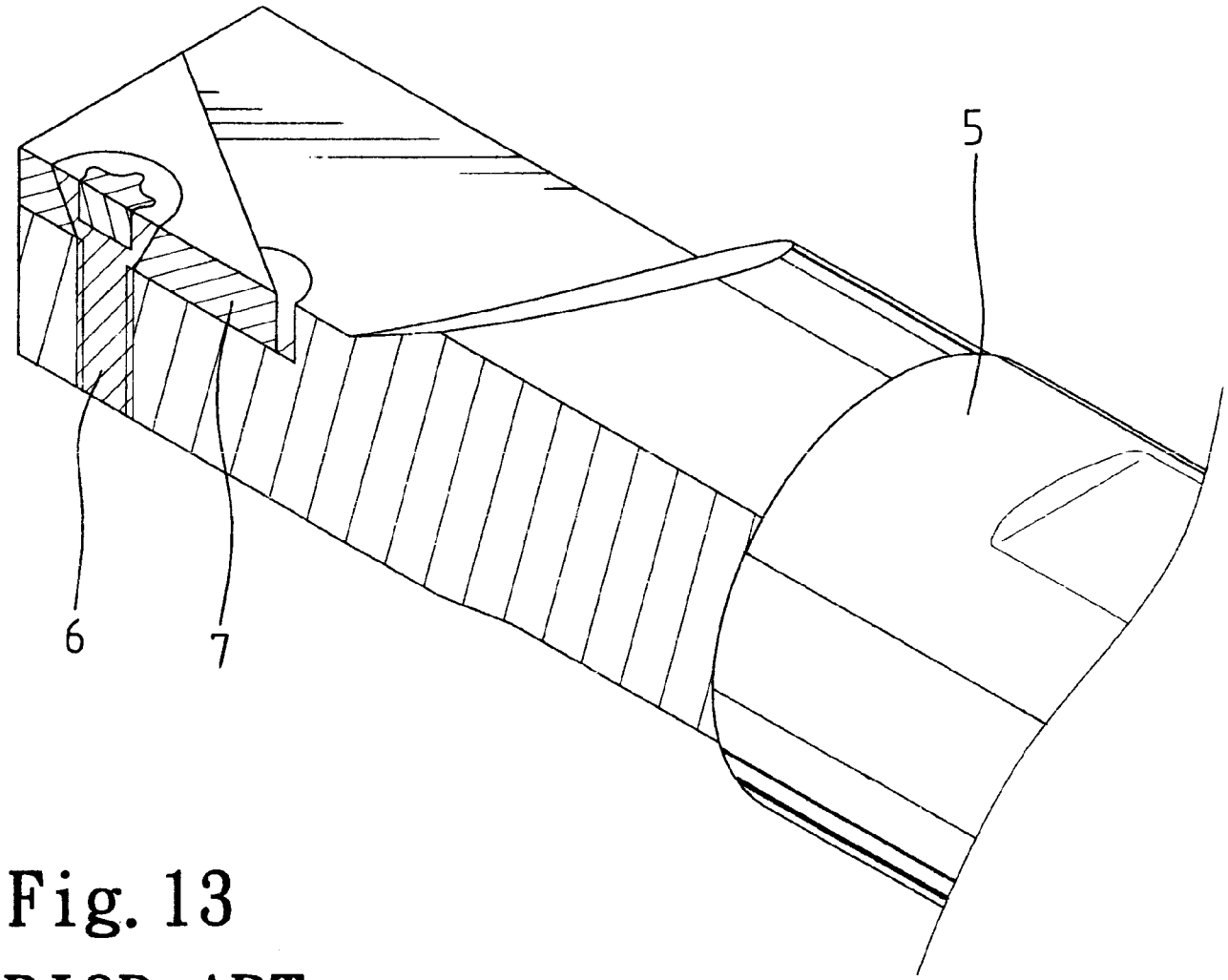
Fig. 13 PRIOR ART
FIG. 13 is a perspective view, partly cutaway, of a cutting tool.

FIGS. 9 through 11 illustrate another modified embodiment of the invention, wherein the casing 30 is substantially rectangular. In addition, there are two receiving sections 34 and two retaining means 40. Operation of this embodiment is substantially the same as that of the first embodiment.

Although the invention has been explained in relation to its preferred embodiment, it is to be understood that many other possible modifications and variations can be made without departing from the scope of the invention as hereinafter claimed.

What is claimed is:

1. A wrench comprising:

a rod comprising a driving portion on an end thereof for engaging with a fastener;

a slide control member securely mounted to the rod to turn therewith;

a casing for rotatably accommodating the slide control member;

retaining means mounted in the casing and including an end operably connected to the slide control member;

wherein when a rotational force applied to the casing is smaller than an engaging force between the slide control member and the end of the retaining means, the slide control member and the rod are turned to thereby turn the fastener;

wherein when a rotational force applied to the casing is greater than the engaging force between the slide control member and the end of the retaining means, the casing slides while the slide control member and the rod are not turned;

wherein the slide control member has a longitudinal hole through which the rod extends; and wherein the rod comprises an embossed section that is securely engaged in the longitudinal hole of the slide control member.

2. The wrench as claimed in claim 1, wherein the retaining means includes a pressing member and an elastic element for biasing the pressing member to press against the slide control member.

3. The wrench as claimed in claim 1, wherein the slide control member is a ratchet wheel.

4. The wrench as claimed in claim 1, wherein the slide control member is a gear.

5. The wrench as claimed in claim 2, wherein the casing includes a first compartment for rotatably receiving the slide control member, a second compartment communicated with the first compartment, and a third compartment communicated with the second compartment, the pressing member being slidably received in the second compartment, and the elastic element being received in the third compartment.

6. The wrench as claimed in claim 5, further comprising a lid for enclosing the first compartment, the second compartment, and the third compartment of the casing.

7. The wrench as claimed in claim 6, wherein the lid comprises a hole through which the rod extends.

8. A The wrench as claimed in claim 1, wherein the casing comprises a positioning hole for receiving another end of the rod.

9. The wrench as claimed in claim 8, further comprising a ball mounted between an end face of said another end of the rod and an end wall defining a portion of the positioning hole.

10. The wrench as claimed in claim 1, wherein the casing comprises a grip portion.

11. A wrench comprising:

a rod comprising a driving portion on an end thereof for engaging with a fastener;

a control member securely mounted to the rod to turn therewith;

a casing for rotatably accommodating the control member, wherein the casing includes a first compartment for rotatably receiving the control member, a second compartment communicated with the first compartment, and a third compartment communicated with the second compartment, wherein the casing comprises a recessed portion surrounding the first compartment, the second compartment, and the third compartment;

retaining means mounted in the casing and including an end operably connected to the control member, wherein the retaining means includes a pressing member and an elastic element for biasing the pressing member to press against the control member, with the pressing member being slidably received in the second compartment, and with the elastic element being received in the third compartment; and a lid mounted in the recessed portion for closing the first compartment, the second compartment, and the third compartment;

wherein when a rotational force applied to the casing is smaller than an engaging force between the control member and the end of the retaining means, the control member and the rod are turned to thereby turn the fastener; and wherein when a rotational force applied to the casing is greater than the engaging force between the control member and the end of the retaining means, the casing slides while the control member and the rod are not turned.

12. The wrench as claimed in claim 11, wherein the lid comprises a hole through which the rod extends.

13. A wrench comprising:

a rod comprising a driving portion on an end thereof for engaging with a fastener;

a control member securely mounted to the rod to turn therewith;

a casing for rotatably accommodating the control member, wherein the casing includes a first compartment for rotatably receiving the control member, a second compartment communicated with the first compartment, and a third compartment communicated with the second compartment;

retaining means mounted in the casing and including an end operably connected to the control member, wherein the retaining means includes a pressing member and an elastic element for biasing the pressing member to press against the control member, with the pressing member being slidably received in the second compartment, and with the elastic element being received in the third compartment;

a lid for enclosing the first compartment, the second compartment, and the third compartment of the casing;

wherein the lid comprises a hole through which the rod extends;

wherein when a rotational force applied to the casing is smaller than an engaging force between the control member and the end of the retaining means, the control member and the rod are turned to thereby turn the fastener; and wherein when a rotational force applied to the casing is greater than the engaging force between the control member and the end of the retaining means, the casing slides while the control member and the rod are not turned.

14. The wrench as claimed in claim 13, wherein the casing comprises a recessed portion surrounding the first compartment, the second compartment, and the third compartment, with the lid mounted in the recessed portion for closing the first compartment, the second compartment, and the third compartment.

15. The wrench as claimed in claim 13, wherein the casing comprises a positioning hole for receiving another end of the rod.

16. The wrench as claimed in claim 15, further comprising a ball mounted between an end face of said another end of the rod and an end wall defining a portion of the positioning hole.

17. The wrench as claimed in claim 13, wherein the control member has a longitudinal hole through which the rod extends.

18. The wrench as claimed in claim 13, wherein the control member is a ratchet wheel.

19. The wrench as claimed in claim 13, wherein the control member is a gear.

20. The wrench as claimed in claim 13, wherein the casing comprises a grip portion.

* * * * *